US009107552B2

(12) United States Patent
Micek et al.

(10) Patent No.: US 9,107,552 B2
(45) Date of Patent: Aug. 18, 2015

(54) COLLAPSIBLE DRYING RACK

(71) Applicant: Lifetime Brands, Inc., Garden City, NY (US)

(72) Inventors: Steven Micek, Saddle Brook, NJ (US); William Edwin Drinkwater, Greenlawn, NY (US)

(73) Assignee: LIFETIME BRANDS, INC., Garden City, NY (US)

( * ) Notice: Subject to any disclaimer, the term of this patent is extended or adjusted under 35 U.S.C. 154(b) by 0 days.

(21) Appl. No.: 13/840,059

(22) Filed: Mar. 15, 2013

(65) Prior Publication Data

US 2014/0263111 A1 Sep. 18, 2014

(51) Int. Cl.
*A47L 19/04* (2006.01)

(52) U.S. Cl.
CPC ..... *A47L 19/04* (2013.01)

(58) Field of Classification Search
CPC ..... A47L 19/02; A47L 19/04; A47L 15/50; A47L 15/503; A47J 47/20; A47B 81/04
USPC ..... 211/41.1, 41.2, 41.3, 41.4, 41.5, 41.6, 211/41.8, 41.9, 85, 85.25, 200, 195, 132.1, 211/133.6, 181.1; 220/571, 572; 4/644, 4/656, 657, 658; 34/192, 238
See application file for complete search history.

(56) References Cited

U.S. PATENT DOCUMENTS

| | | | | |
|---|---|---|---|---|
| 53,055 | A | | 3/1866 | Stone et al. |
| 222,542 | A | | 12/1879 | Stearns |
| 329,150 | A | | 10/1885 | Eaton |
| 378,692 | A | | 2/1888 | Latham |
| 424,863 | A | | 4/1890 | Demorest |
| 499,881 | A | | 6/1893 | Goldstein |
| 542,734 | A | | 7/1895 | Johnson |
| 724,252 | A | | 3/1903 | Blackwood |
| 946,977 | A | * | 1/1910 | Muller ..... 211/41.6 |
| 990,454 | A | | 4/1911 | Peters |
| 1,006,328 | A | * | 10/1911 | Widenhofer ..... 211/195 |
| 1,008,124 | A | | 11/1911 | Dudley |
| 1,012,869 | A | * | 12/1911 | Lauzon ..... 126/369 |
| 1,020,004 | A | * | 3/1912 | Wishman ..... 99/384 |
| 1,522,921 | A | | 1/1925 | Smiley |
| 1,714,629 | A | * | 5/1929 | Rodin ..... 211/195 |
| 1,822,087 | A | | 9/1931 | Feingold |
| 1,835,232 | A | * | 12/1931 | Lord ..... 211/85 |
| 1,971,523 | A | | 8/1934 | Feingold |
| 2,039,927 | A | | 5/1936 | Poglein |
| 2,236,339 | A | * | 3/1941 | Keith ..... 4/657 |
| 2,441,417 | A | | 5/1948 | Hopkins |
| 2,443,404 | A | * | 6/1948 | Domiano ..... 211/41.4 |
| 2,479,118 | A | * | 8/1949 | Jenness ..... 211/41.5 |
| 2,516,088 | A | | 7/1950 | Einhorn |

(Continued)

FOREIGN PATENT DOCUMENTS

FR 785668 A * 8/1935

*Primary Examiner* — Stanton L Krycinski
(74) *Attorney, Agent, or Firm* — Tutunjian & Bitetto, P.C.

(57) ABSTRACT

A collapsible drying rack having a flexible base capable of being folded along at least one fold line or axis, and a substantially rigid drying support secured to a portion of the flexible base. The drying support has one or more tines configured to have a first folded position and a second upright operable position. A locking mechanism secures the tines in their upright operable position. The flexible base can be folded over the drying support (when the tines are folded down) and secured in the folded position for storage.

13 Claims, 10 Drawing Sheets

(56) References Cited

U.S. PATENT DOCUMENTS

| | | | | |
|---|---|---|---|---|
| 3,005,209 | A * | 10/1961 | Timmons, Jr. et al. | 4/657 |
| D247,416 | S | 3/1978 | Berman et al. | |
| D252,251 | S | 7/1979 | Lundahl | |
| 4,212,400 | A | 7/1980 | Buchsteiner | |
| D258,928 | S | 4/1981 | Buchsteiner | |
| 4,328,899 | A | 5/1982 | Krusche | |
| 4,592,471 | A | 6/1986 | Bross | |
| 4,969,560 | A | 11/1990 | Stanfield | |
| 5,465,654 | A * | 11/1995 | Lampi et al. | 99/422 |
| 5,503,279 | A | 4/1996 | Wentworth | |
| D370,323 | S | 5/1996 | Lafond | |
| 5,649,630 | A | 7/1997 | Remmler | |
| D398,725 | S | 9/1998 | Merkel | |
| D418,354 | S | 1/2000 | O'Rourke | |
| 6,038,784 | A | 3/2000 | Dunn et al. | |
| 6,065,394 | A * | 5/2000 | Gelderman | 99/449 |
| D429,863 | S | 8/2000 | Lenney | |
| 6,125,548 | A | 10/2000 | Dunn et al. | |
| 6,170,676 | B1 | 1/2001 | Patadia et al. | |
| D439,716 | S | 3/2001 | Wright | |
| D446,369 | S | 8/2001 | Smith et al. | |
| 6,357,605 | B1 | 3/2002 | Martorella | |
| 6,364,130 | B2 | 4/2002 | Wright | |
| 6,502,704 | B2 | 1/2003 | Martorella et al. | |
| 6,516,956 | B2 | 2/2003 | Martorella et al. | |
| 6,547,080 | B1 * | 4/2003 | Guard | 210/464 |
| D490,198 | S | 5/2004 | Jerstroem et al. | |
| D532,948 | S | 11/2006 | Gillisie | |
| D534,701 | S | 1/2007 | Schmidt | |
| 7,458,470 | B2 | 12/2008 | Jerstroem et al. | |
| 7,475,785 | B1 | 1/2009 | Kidd | |
| 7,578,401 | B2 | 8/2009 | Schnitzer | |
| 7,665,475 | B2 | 2/2010 | Hedstrom et al. | |
| D628,005 | S | 11/2010 | Chapman et al. | |
| D634,909 | S | 3/2011 | Guthrie | |
| 8,087,108 | B2 | 1/2012 | Burns et al. | |
| 8,118,179 | B2 | 2/2012 | Smith | |
| RE43,349 | E | 5/2012 | Dunn et al. | |
| D659,458 | S | 5/2012 | Lerman | |
| RE43,635 | E | 9/2012 | Dunn et al. | |
| 8,356,719 | B2 * | 1/2013 | Haltmayer et al. | 211/41.8 |
| 8,573,410 | B2 * | 11/2013 | Chalifoux | 211/41.5 |
| 2001/0040141 | A1 | 11/2001 | Martorella et al. | |
| 2004/0134866 | A1 | 7/2004 | Jerstroem et al. | |
| 2004/0238464 | A1 | 12/2004 | Cheung | |
| 2005/0145583 | A1 | 7/2005 | Martorella et al. | |
| 2007/0144984 | A1 * | 6/2007 | Sullivan et al. | 211/41.3 |
| 2007/0151937 | A1 | 7/2007 | Gillisie | |
| 2008/0210648 | A1 | 9/2008 | Davis | |
| 2008/0263762 | A1 * | 10/2008 | Burns et al. | 4/657 |
| 2008/0283480 | A1 | 11/2008 | Segall et al. | |
| 2008/0308509 | A1 * | 12/2008 | Giuseppe | 211/41.3 |
| 2009/0211994 | A1 | 8/2009 | Yang et al. | |
| 2012/0208416 | A1 * | 8/2012 | Lerman | 442/1 |

* cited by examiner (A)

(B)

COLLAPSIBLE DRYING RACK

BACKGROUND

1. Technical Field

The present invention relates to kitchen devices. More particularly, it relates to a collapsible and foldable drying rack for use in drying kitchen items after they have been washed.

2. Description of Related Art

The use of drying racks or other types of device to hold items after they have been washed so as to allow them to air dry are well known and commonly include a solid base made of plastic, and a rack configured to hold dishes, cups and utensils, and which is generally configured to rest on the solid base.

Although there are many drawbacks to the use of known drying rack and the configurations, one primary drawback is they take up valuable counter space, often immediately adjacent a kitchen sink. In addition, since both the base and drying rack are rigid in construction, the removal from the counter top and storage in another location when not in use also presents problems since the two parts are bulky and often difficult to store.

SUMMARY

The drying rack of the present invention overcomes the shortfalls of known drying rack configurations by providing a flexible base capable of folding at least in half, and which includes a collapsible rigid drying support releasably secured to the flexible base.

These and other aspects are achieved in accordance with an implementation of the present invention where the collapsible drying rack includes flexible base configured to be folded and having at least one clip positioned on one side of a fold line. A drying support is positioned within the at least one clip and includes at least one pivotable support having a plurality of tines. The at least one support has a first folded storage position and a second upright operable position. The flexible base can be folded while the drying support is positioned within the at least one clip and the at least one support is in the folded position.

Other aspects and features of the present principles will become apparent from the following detailed description considered in conjunction with the accompanying drawings. It is to be understood, however, that the drawings are designed solely for purposes of illustration and not as a definition of the limits of the present principles, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

In the drawings wherein like reference numerals denote similar components throughout the views.

DETAILED DESCRIPTION

Figure 1:
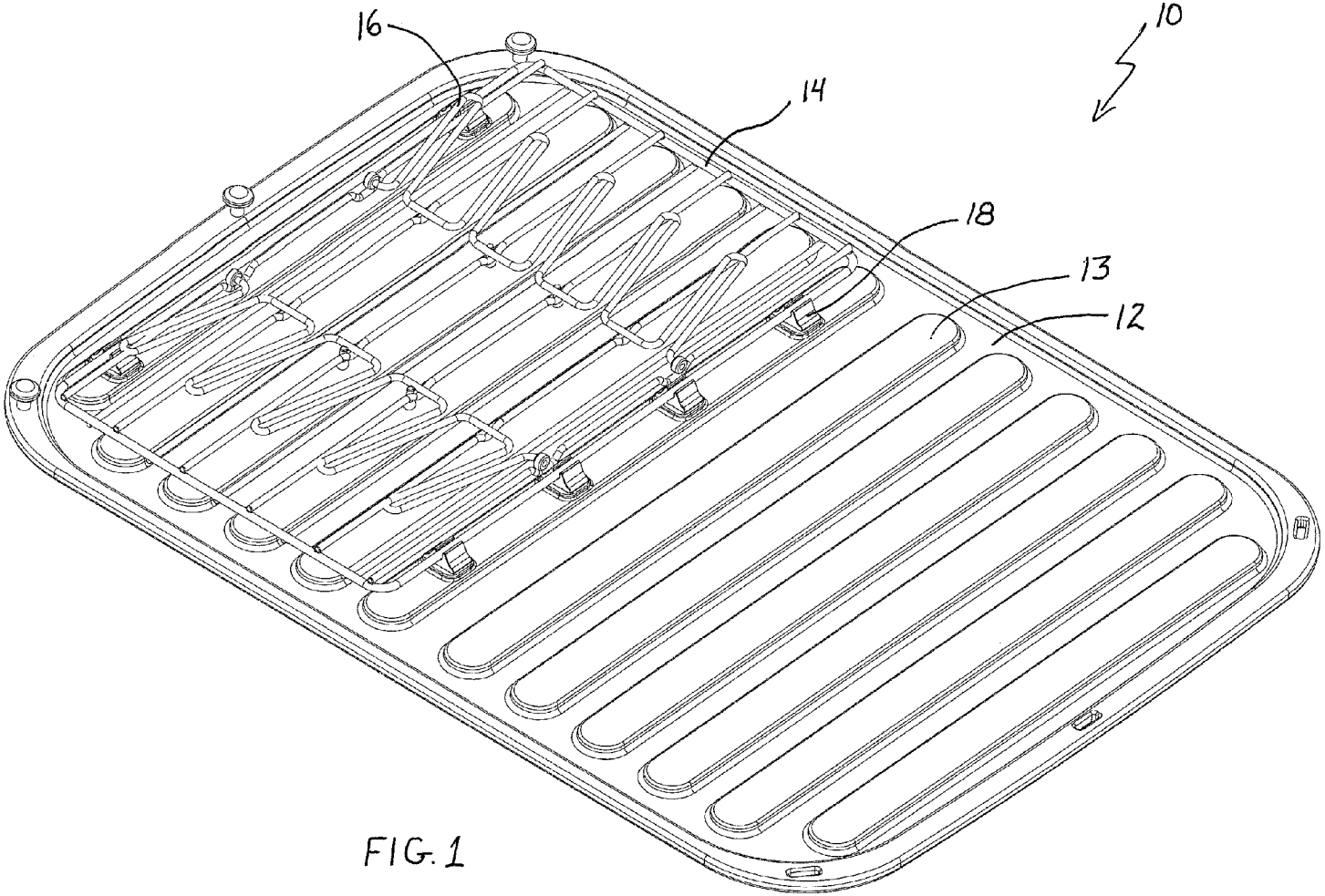
FIG. 1 is a perspective view of the collapsible drying rack according to an embodiment of the invention.

Although preferred embodiments of the invention are explained in detail, it is to be understood that other embodiments are contemplated. Accordingly, it is not intended that the invention is limited in its scope to the details of construction and arrangement of components set forth in the following description or illustrated in the drawings. The invention is capable of other embodiments and of being practiced or carried out in various ways. Also, in describing the preferred embodiments, specific terminology will be resorted to for the sake of clarity.

It must also be noted that, as used in the specification and the appended claims, the singular forms "a," "an" and "the" include plural referents unless the context clearly dictates otherwise.

It is intended that each term contemplates its broadest meaning as understood by those skilled in the art and includes all technical equivalents that operate in a similar manner to accomplish a similar purpose.

Ranges may be expressed herein as from "about" or "approximately" one particular value and/or to "about" or "approximately" another particular value. When such a range is expressed, another embodiment includes from the one particular value and/or to the other particular value.

By "comprising" or "containing" or "including" is meant that at least the named compound, element, particle, or method step is present in the composition or article or method, but does not exclude the presence of other compounds, materials, particles, method steps, even if the other such compounds, material, particles, method steps have the same function as what is named.

It is also to be understood that the mention of one or more method steps does not preclude the presence of additional method steps or intervening method steps between those steps expressly identified. Similarly, it is also to be understood that the mention of one or more components in a device or system does not preclude the presence of additional components or intervening components between those components expressly identified.

With reference to the drawings, embodiments of a foldable and collapsible drying rack with the principles and concepts of the present invention will be described. Embodiments of a releasable and collapsible drying rack mechanism with the principles and concepts of the present invention will also be described.

While the embodiments described herein are intended as exemplary foldable and collapsible drying racks and corresponding mechanisms for the same, it will be appreciated by those skilled in the art that the present invention is not limited to drying racks and may be employed in a variety of different drying systems.

Figure 2:
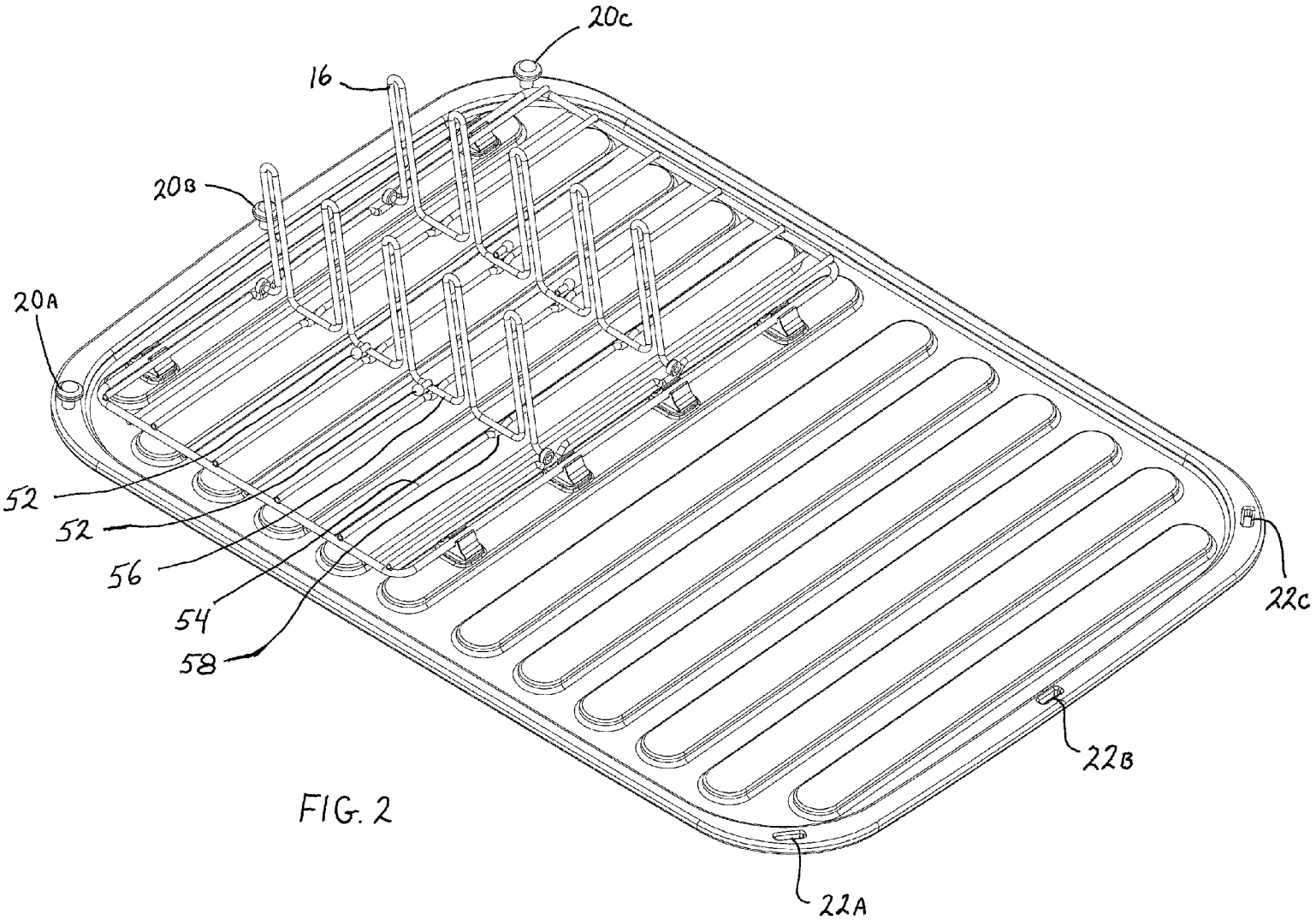
FIG. 2 is a perspective view of the collapsible drying rack according to an embodiment of the invention.

Referring to FIGS. 1-2, there is shown the collapsible drying rack 10 according to an implementation of the present invention. The collapsible drying rack 10 is made up of two primary parts, a flexible base 12, and a substantially rigid yet collapsible drying support 14.

The flexible base 12 has a plurality of raised ribs 13 which form a lower region 11 between and around the ribs 13. The lower region 11 is configured to catch the water from the items drying on the base 12 or support 14. In a preferred implementation, the flexible base may be made of any suitable material capable of being folded, for example silicone. Other suitable materials may include thermoplastic rubbers (TPRs), thermoplastic elastomers (TPEs) or rubber. In an alternative embodiment, base 12 may have a combination of rigid sections and flexible sections, where the flexible sections are between the rigid sections and allow the base to be folded along the one or more flexible sections.

In this exemplary embodiment, a drying support 14 is releasably connected to the base via clips 18. The drying support 14 includes collapsible supports 16 having tines which have a folded or collapsed position (FIG. 1), and an upright support position (FIG. 2).

As shown in FIGS. 1-2, flexible base 12, with clips 18 is configured to receive the drying support 14 on approximately half of the overall length of the base. In this configuration, the flexible base 12 can be folded about a fold line or axis C (FIG. 3) while dish support 14 remains secured within the clips 18. Other implementations are contemplated where drying support 14 can take different shapes and sizes without departing from the spirit of the present disclosure. For example, the drying support could be triangular and positioned in a corner of the flexible base. Drying support 14 can be made of any suitable material, such as, for example, a wire frame made of treated steel, rigid plastics, and/or combinations of plastics and metals.

The flexible base 12 also includes means for retaining the base in a folded configuration. In accordance with one example, the means for retaining can include one or more apertures 22 on one edge of the base, and a corresponding one or more headed posts 20 on an opposing edge of the base. In the exemplary embodiment shown, there are three apertures 22A-22C and corresponding headed posts 20A-20C. Those of skill in the art will appreciate that different side and shape flexible bases may require less or more means for retaining the same in a folded position.

Figure 3:
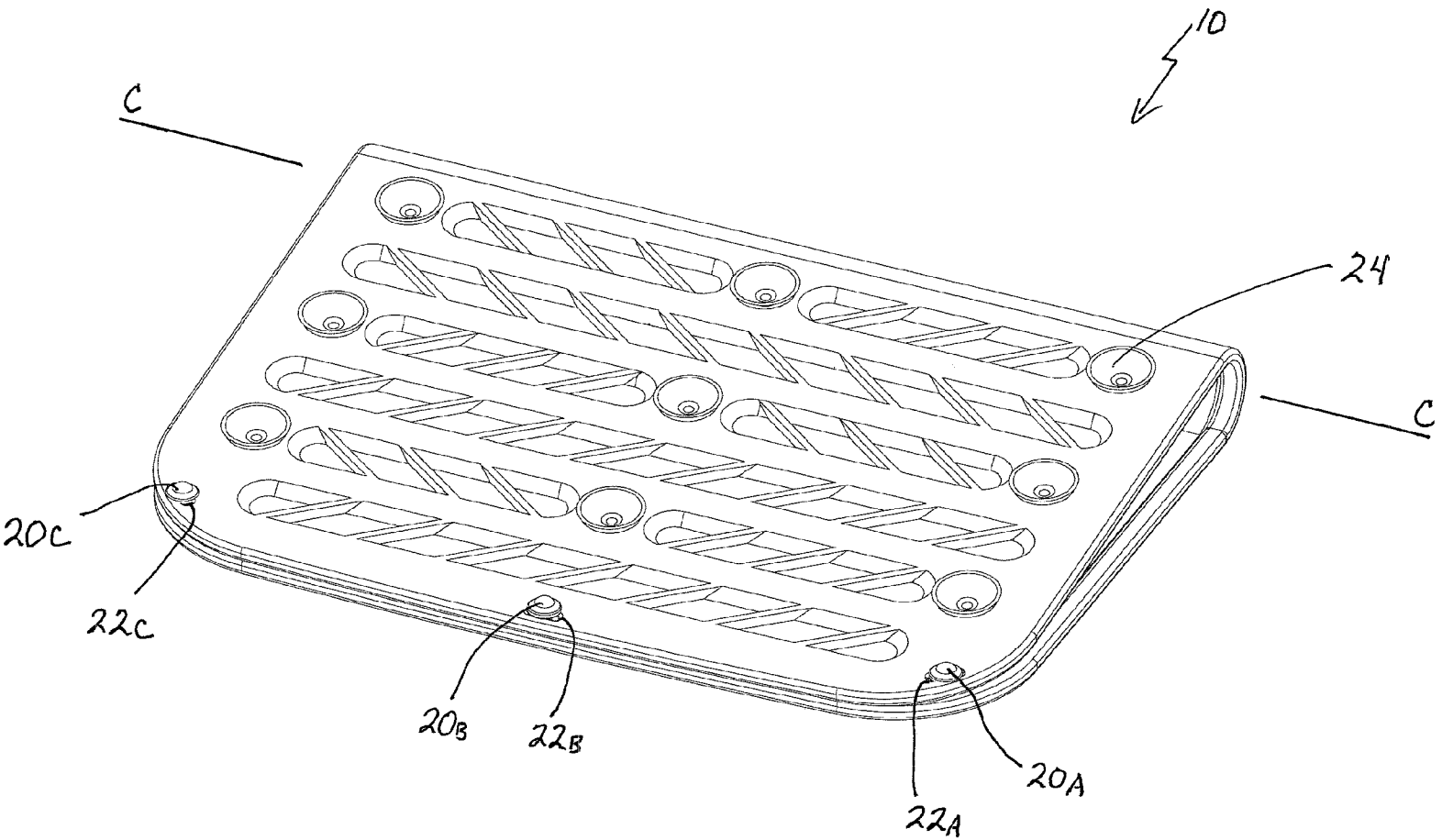
FIG. 3 is a perspective view of the collapsible drying rack in a folded position, according to an embodiment of the invention.

Referring to FIG. 3, there is shown the collapsible drying rack 10 in its folded or closed storage position. Here, base 12 has been folded along a fold line C and the headed posts 20 have been pushed through the respective holes 22. Although the exemplary embodiment shows the flexible base being folded in half, it is contemplated that the flexible base could be configured to fold more than once, for example two folds to create a tri-fold when in storage mode. As will also be appreciated, the bottom of the flexible base 12 can also include a plurality of suction cup supports 24 for securing the flexible base on a hard surface support (e.g., counter top) when in use.

Figure 4:
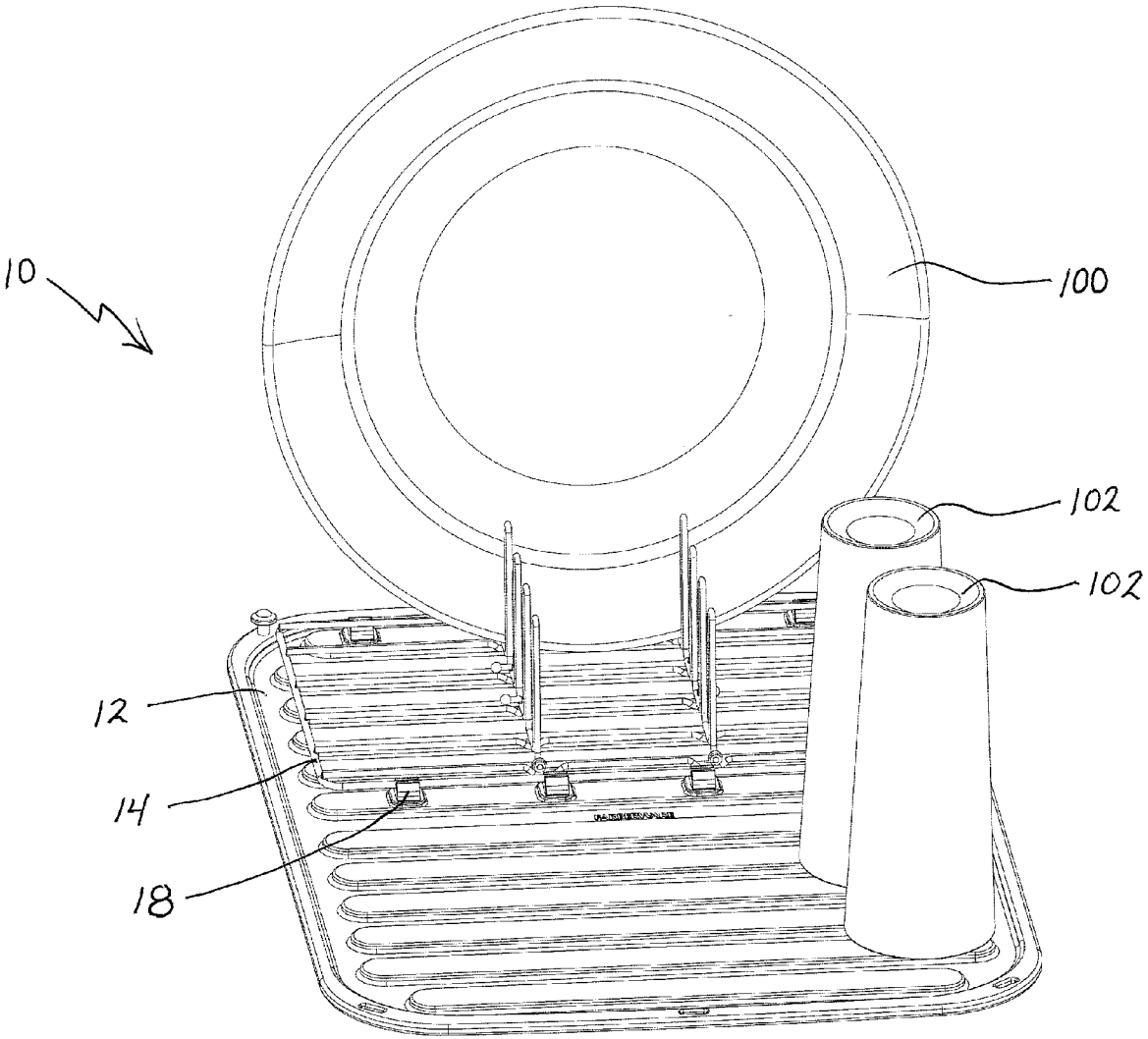
FIG. 4 is a perspective view of the collapsible drying rack in use and according to an embodiment of the invention.

FIG. 4 shows an example of the collapsible drying rack 10 in use. As shown, the rigid drying support 14 has a dish 100 positioned thereon, while glasses 102 or other items not requiring a support can be positioned anywhere else on the raised ribs 13 of the base 12.

Figure 5A:
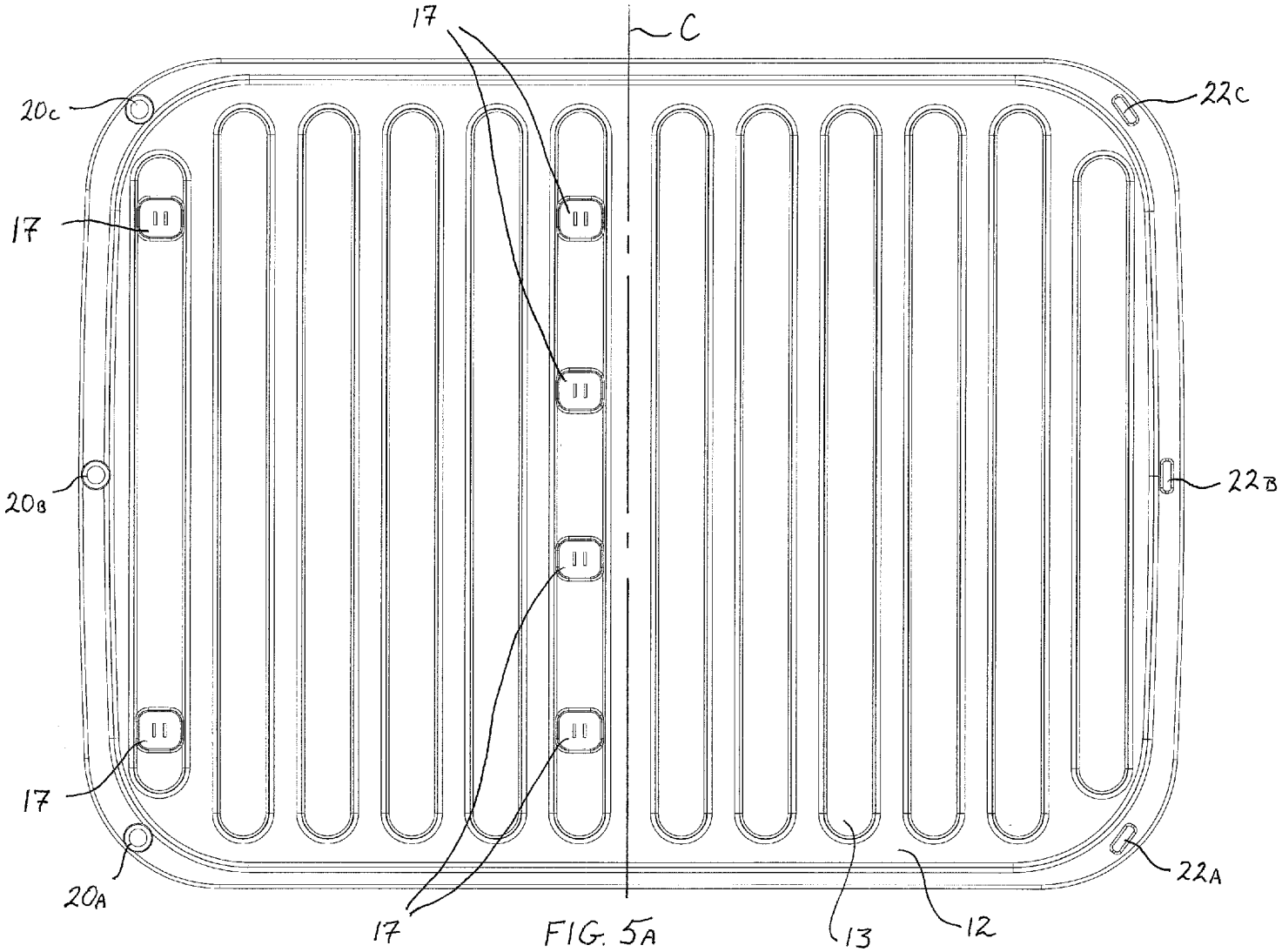
FIG. 5A is a top view of the flexible base of the collapsible drying rack without the collapsible rigid dish support according to an embodiment of the invention.

Referring to FIG. 5A, there is shown the flexible base 12 of the collapsible drying rack 10 according to an embodiment of the invention. In this configuration, base 12 includes receiving slots 17 which are designed to receive clips 18 for receiving and securing the rigid dish support 14 in its operable position. Those of skill in the art will appreciate that the configuration of the slots 17 can be changed to accommodate different clips used for different drying supports.

Figure 5B:
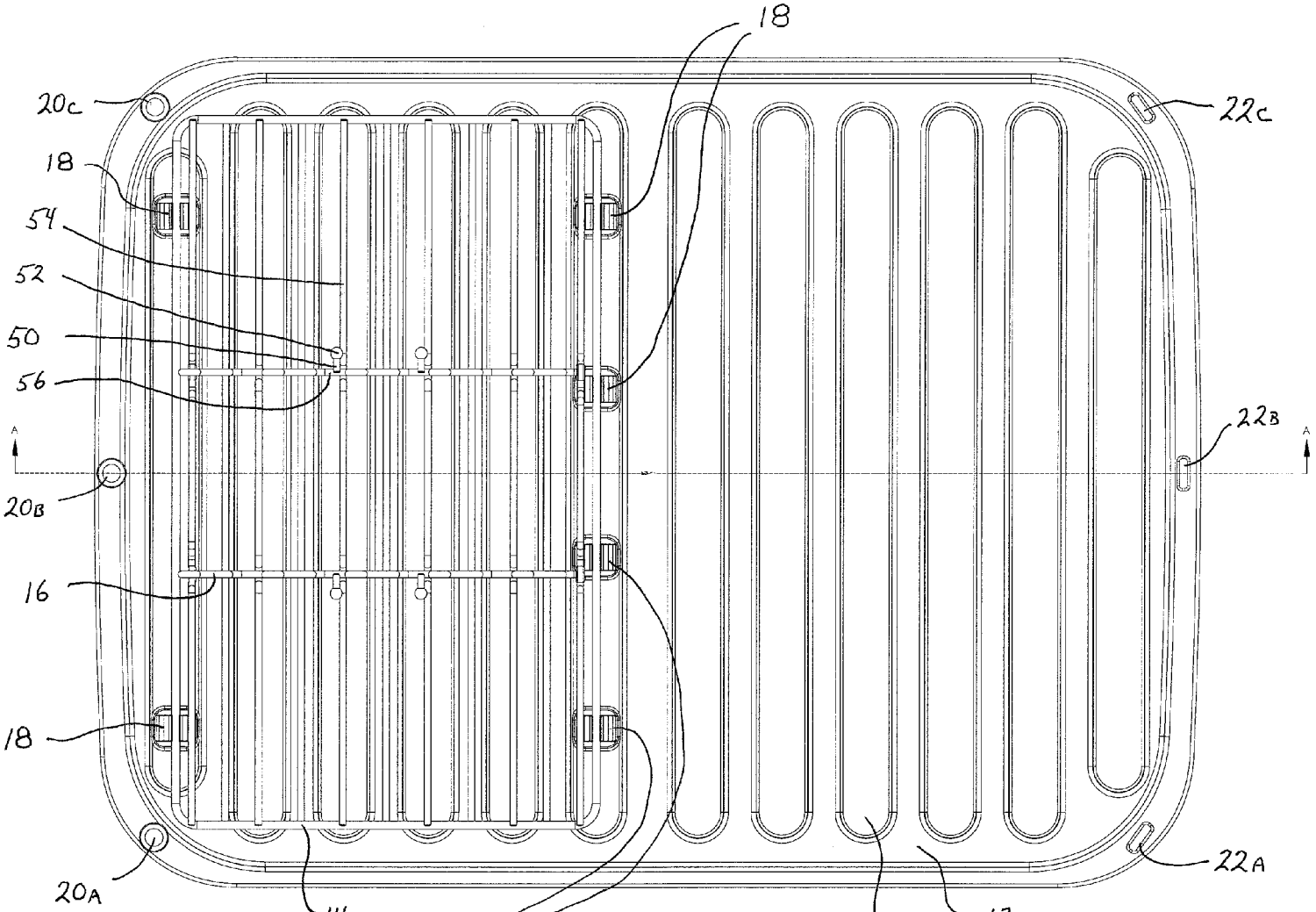
FIG. 5B is a top view of the flexible base of the collapsible drying rack with the collapsible rigid dish support in place according to an embodiment of the invention.

FIG. 5B shows the base 12 with clips 18 disposed in the respective slots 17 and the rigid drying support 14 positioned within the clips 18. In this example, the supports 16 are shown locked in their upright and operable position. The locking of supports 16 is performed, by way of example, using tension tabs 50. In this exemplary embodiment, tension tabs 50 include a bulbous or spherical head 52 which is slightly offset from a lower rail 56 of the supports 16.

Figure 6:
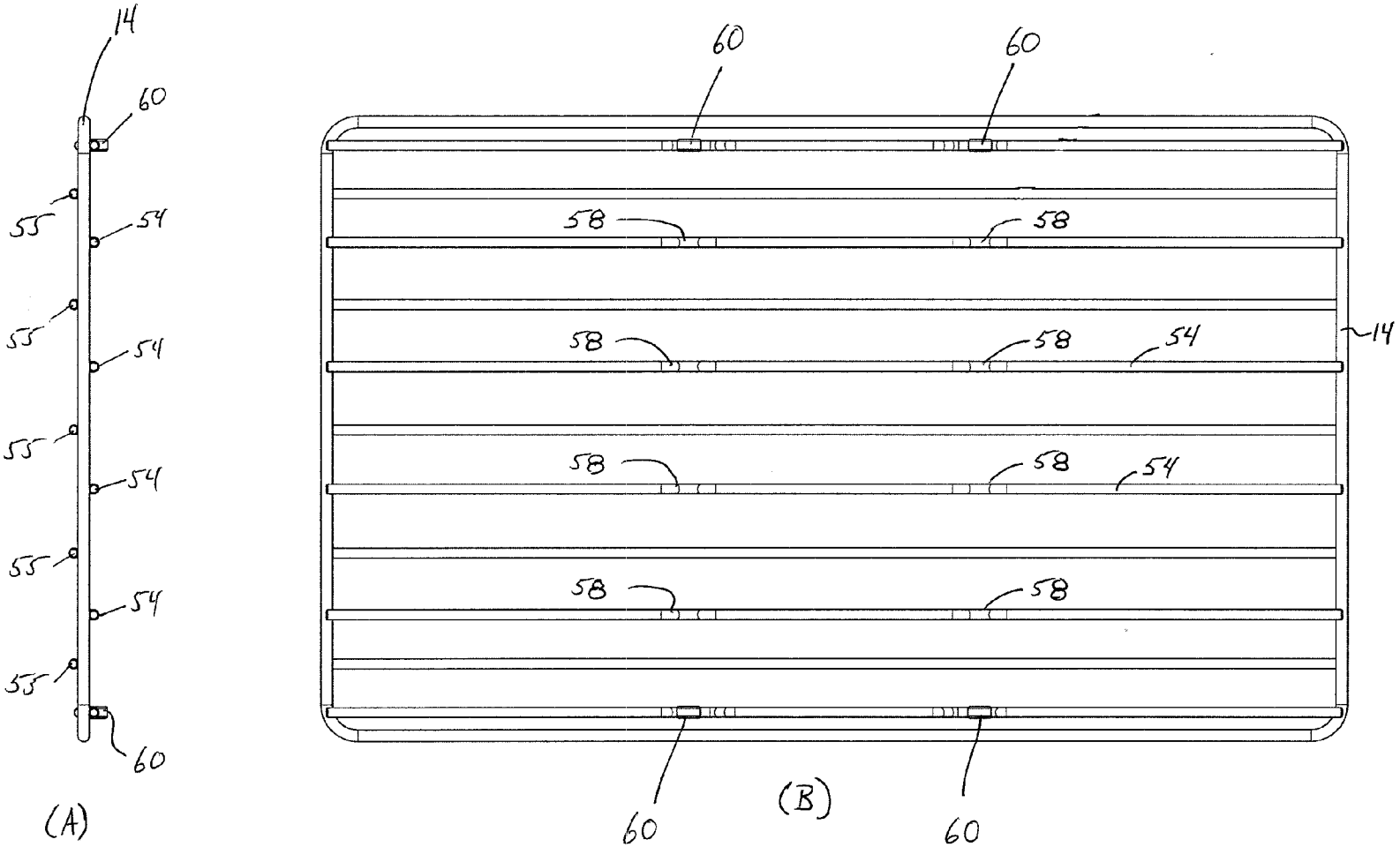
FIGS. 6A and 6B show the rigid drying rack according to an embodiment of the invention.

Referring to FIGS. 6A and 6B, an example of the drying support 14 is shown having a wire frame type construction and includes upper frame members 54 and lower frame members 55 in an alternating arrangement. Those of skill in the art will appreciate that this alternating arrangement of upper members 54 and lower members 55 increases the overall integrity of the support 14. Pivot mounts 60 are provided on opposite sides of the rack 14 and are configured to receive the ends 62 (FIG. 7A) of the supports 16. In the exemplary embodiments shown, each upper member 54 includes an indentation or curved portion 58 so as to provide a plurality of portions 58 that are aligned with each other and the corresponding pivot mounts 60 on each side of the support 14. The inclusion of such indentations or curved portions 58 is optional and not required for pivoting supports 16 from their folded position to their upright operable position.

Figure 7:
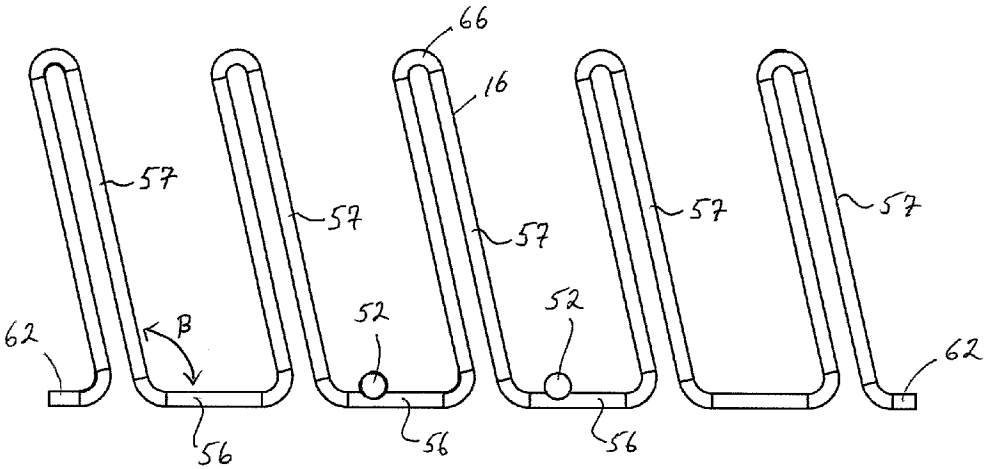
FIG. 7A is a side view of a collapsible rigid dish support according to another embodiment of the invention.
FIG. 7B is a side view of the collapsible rigid dish support shown in FIG. 7A, according to an embodiment of the invention.
FIG. 7C is a side view of the collapsible drying rack according to an embodiment of the invention.
FIG. 7D is a cross-sectional view of the collapsible drying rack taken along line A-A of FIG. 5B, according to an embodiment of the invention.
Figure 7:
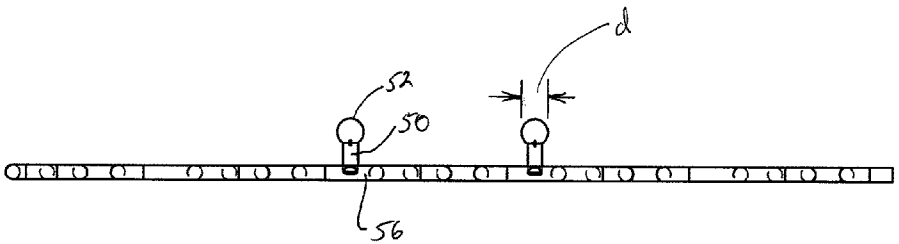
Figure 7:
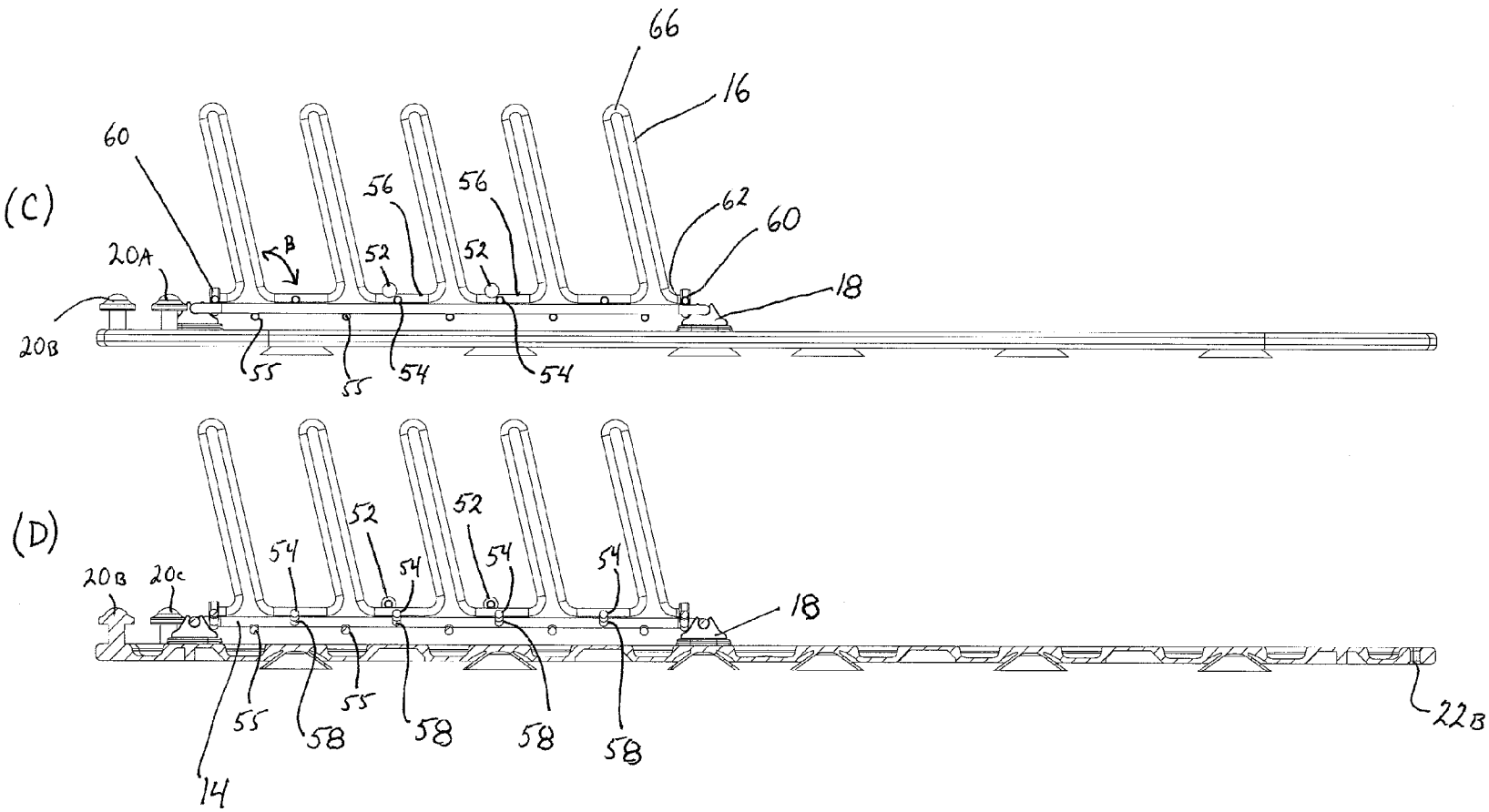

Referring to FIGS. 7A-7B, there is shown the foldable support 16 of the drying rack 14 according to an embodiment of the invention. The foldable support 16 is preferably made of the same material as the rack 14, and can be configured using a wire frame like construction as shown. The foldable support 16 includes a plurality of spaced tines 57, which are spaced apart from each other and include a bottom or lower horizontal member 56 between each tine 57. The top 66 of each tine 57 can include a coating of a non-slip material (e.g., silicon, rubber, etc.) so that tines 57 provide additional support to the dishes or other items being support therein. Each end 62 of the support 16 is configured to be inserted into and retained by the pivot mounts 60 disposed on the upper frame members of the rack 14. In accordance with one embodiment the tines 57 are angularly disposed with respect to the lower horizontal member at a predetermined angle β. Generally speaking, β can be in a range from 90°-120°. In the present example, β~105°.

In accordance with one embodiment, the locking mechanism of the foldable supports 16 is realized by including tension tabs 50 which are configured to secure support 16 in its upright operable position. Tension tabs 50 protrude from the lower member 56 at a right angle thereto and include stops 52 that can be bulbous or spherical in shape. The stops 52 have a diameter d which is sufficiently sized such that the pivotal movement of support 16 from the folded position into the upright operable position causes the stops 52 to physically engage the cross member 54 to which it is adjacently mounted. (See FIGS. 7C & 7D) The stops 52 force the cross members 54 to be pushed slightly away from the same such that when the stop 52 reaches a predetermined point, the stop will "snap" upward and will come to rest against on an upper portion of the cross member 54, thereby securing the support 16 in its upright operable position.

In order to close or fold the supports 16, by applying force to the support 16 in the folding direction, the supports will pivot about connection points 60 and force the stops 52 to again urge the corresponding cross member 54 outward until the engagement with the stop has released and the support 16 freely folds down to the collapse storage position. In accordance with an implementation, the diameter d of stops 52 is larger than the diameter of the wire frame members 54.

In accordance with other alternate embodiments, the locking mechanism for securing the supports 16 in their upright position could include locking pivot points 60. In this implementation, the ends 62 of the support 16 would be connected to an internal mechanism of the pivots and the pivots would allow for rotation of 90 degrees from the folded position to the upright position. The pivots would have a locking or ratcheting feature which would operate to retain the support in any desired angular position between 0°-90°.

Those of skill in the art will appreciate that other locking mechanisms for securing the supports 16 in their upright operable position may be employed without departing from the spirit of the present disclosure. For example, a friction hinge with bushings at the pivot points could be used. Here, plastic bushings would be attached to the pivot points and operate to create friction. This would allow an infinite adjustment of the support between the folded position and the upright operable position.

Other examples of locking mechanisms could include a set of plastic clips that would keep support 16 locked in the upright operable (i.e., vertical) or folded (i.e., horizontal) position. An example of such plastic clip can be found is dishwasher racks.

It is further contemplated that supports 16 would simply be detachable from pivot points 60 and can be removed and re-inserted in the upright position, and/or removed and re-inserted in the horizontal folded position.

In other embodiments, the supports 16 could include a leg that is welded or otherwise fixedly attached of the same such that the leg would rest either on the base 12 or the rack 14. The leg would rotate with the supports 16 and retain the same in the upright operable position while also operating to prevent supports 16 from over rotating.

Figure 8A:
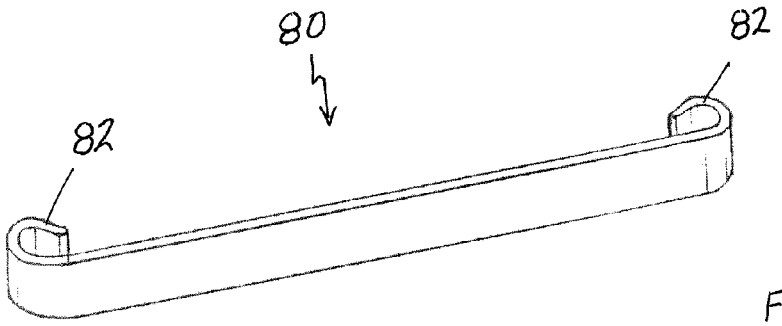
FIGS. 8A-8C show alternative locking mechanisms for use with the collapsible drying rack according to another embodiment of the invention.
Figure 8B:
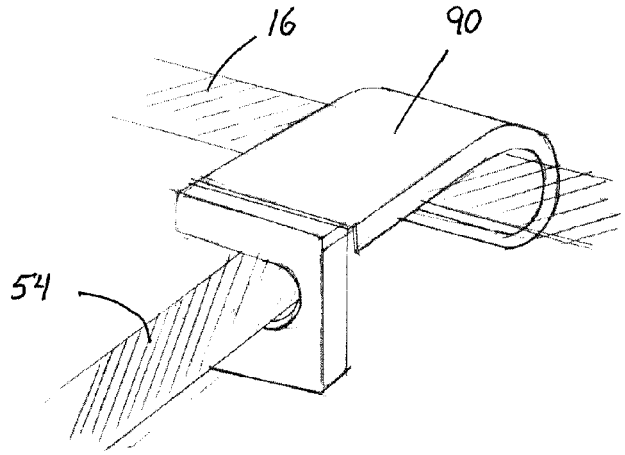
Figure 8C:
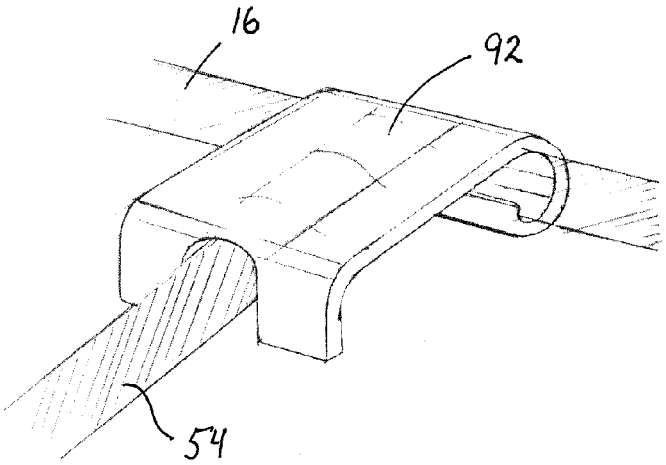

FIGS. 8A-8C show alternative devices that can be used as the locking mechanism for supports 16. FIG. 8A shows an example of a crossbar 80 with hooks 82 which could be installed in place once support 16 has been moved to its upright operable position. The cross bar 80 could be made of sheet metal or plastic and would engage supports 16 to keep them locked upright. Removal of the crossbar 80 would release the supports and allow the same to be folded down into their storage position.

FIG. 8B shows a U-shaped hook 90 that is attached support 16 and which engages with the cross member 54 of the rack 14. In this configuration, hook 90 would engage the cross member 54 of the rack 14 when the support 16 is moved horizontally.

FIG. 8C shows an example of a hook 92 that is attached to support 16, and which engages the cross member 54 of the rack 14 when the support is moved into its upright operable position. The hook 92 would prevent the supports from over rotating and keep them in their upright operable position during use. The hook 90 could be configured, for example, to snap onto the cross member 54, however such "snap" connection is not necessary to achieve the desired function.

While there have been shown, described and pointed out fundamental novel features of the present principles, it will be understood that various omissions, substitutions and changes in the form and details of the methods described and devices illustrated, and in their operation, may be made by those skilled in the art without departing from the spirit of the same. For example, it is expressly intended that all combinations of those elements and/or method steps which perform substantially the same function in substantially the same way to achieve the same results are within the scope of the present principles. Moreover, it should be recognized that structures and/or elements and/or method steps shown and/or described in connection with any disclosed form or implementation of the present principles may be incorporated in any other disclosed, described or suggested form or implementation as a general matter of design choice. It is the intention, therefore, to be limited only as indicated by the scope of the claims appended hereto.

What is claimed is:

1. A collapsible drying rack comprising:

a flexible base configured to be folded and having at least one clip positioned on one side of, and adjacent to a fold line; and a drying support positioned within the at least one clip and having at least one pivotable support having a plurality of tines and a pivoting axis perpendicular to the fold line, the at least one support having a first folded storage position and a second upright operable position, wherein the flexible base can be folded while said drying support is positioned within the at least one clip and the at least one support is in the folded position.

2. The collapsible drying rack according to claim 1, wherein said flexible base further comprising a retention mechanism for retaining the flexible base in a folded position.

3. The collapsible drying rack according to claim 1, wherein said drying support further comprising a locking mechanism integrated into the at least one pivotable support and configured to releasably secure said at least one pivotable support in said second upright operable position.

4. The collapsible drying rack according to claim 1, wherein said drying support comprises:

a frame with a plurality of cross members;

pivot connection points on opposite sides of the frame, said at least one pivotable support having ends configured to be received and retained by opposing ones of said pivot connection points; and a locking mechanism integrated into the at least one pivotable support and configured to engage said cross members to secure said at least one pivotable support in said second upright operable position.

5. The collapsible drying rack according to claim 2, wherein said retention mechanism comprises at least one aperture in an edge of the flexible base, and at least one headed post positioned on an opposite edge of the flexible base, said at least one headed post mating with said at least one aperture when the flexible base is folded.

6. The collapsible drying rack according to claim 3, wherein the locking mechanism comprises:

at least one tension tab positioned on a lower member of said at least one pivotable support, said at least one tension tab engaging a cross member of said drying support when the at least one support is pivoted from its folded position to its upright operable position, wherein at a predetermined angle of rotation from the folded position, the tension tab snaps over the engaged cross member to secure the at least one pivotable support in the upright position.

7. The collapsible drying rack according to claim 1, wherein the flexible base comprises an upper surface and a lower surface, said upper surface having a plurality of raised ribs and said at least one clip, and said lower surface having a plurality of suction cups for securing the flexible base on a hard surface during use.

8. A collapsible drying rack comprising:

a flexible base configured to be folded along at least one fold line and having at least one clip positioned on one side of, and adjacent to, the at least one fold line, the flexible base further comprising a retention mechanism for retaining the flexible base in a folded position; and a rigid drying support positioned within the at least one clip and having at least two pivotable supports each having a plurality of tines and a pivoting axis arranged perpendicular to the at least one fold line, the at least two pivotable supports having a first folded storage position and a second upright operable position, the rigid drying support further comprising:

a frame with a plurality of cross members;

pivot connection points on opposite sides of the frame, said at least two pivotable supports having ends configured to be received and retained by opposing ones of said pivot connection points; and a locking mechanism integrated into each of the at least two pivotable supports and configured to engage said cross members to secure said supports in said second upright operable position;

wherein the flexible base can be folded while the rigid drying support is positioned within the at least one clip and the at least two pivotable supports are in the folded position.

9. The collapsible drying rack as recited in claim 8, wherein the rigid drying support locking mechanism comprises:

at least one tension tab positioned on a lower member of each of said at least two pivotable supports, said at least one tension tab engaging a respective cross member of said drying support when the at least two pivotable supports are pivoted from their folded position to their upright operable position, wherein at a predetermined angle of rotation from the folded position, the at least one tension tab snaps over the respective cross member to secure the at least two pivotable supports in the upright position.

10. The collapsible drying rack as recited in claim 8, wherein said the retention mechanism comprises at least one aperture in an edge of the flexible base, and at least one headed post positioned on an opposite edge of the flexible base, said at least one headed post mating with said at least one aperture when the flexible based is folded.

11. The collapsible drying rack of claim 1, wherein the fold line is along a center line of the flexible base.

12. The collapsible drying rack of claim 1, wherein the drying support covers less than one half of the flexible base when in its upright operable position.

13. The collapsible drying rack of claim 1, wherein the flexible base comprises a plurality of linearly arranged clips adjacent to the fold line and a plurality of linearly arranged clips at an end of the flexible base, each of said linearly arranged clips being oriented parallel to the fold line.

* * * * *